US008038001B2

(12) United States Patent
Holford

(10) Patent No.: US 8,038,001 B2
(45) Date of Patent: Oct. 18, 2011

(54) CURVED CIGARETTE PACK FLAP FORMATION ON CURVED SURFACES

(75) Inventor: Steven Holford, Southampton (GB)

(73) Assignee: British American Tobacco (Investments) Limited, London (GB)

( * ) Notice: Subject to any disclaimer, the term of this patent is extended or adjusted under 35 U.S.C. 154(b) by 119 days.

(21) Appl. No.: 12/279,534

(22) PCT Filed: Jan. 19, 2007

(86) PCT No.: PCT/GB2007/000163

§ 371 (c)(1),
(2), (4) Date: Oct. 20, 2008

(87) PCT Pub. No.: WO2007/093758

PCT Pub. Date: Aug. 23, 2007

(65) Prior Publication Data

US 2009/0218242 A1 Sep. 3, 2009

(30) Foreign Application Priority Data

Feb. 16, 2006 (GB) ..... 0603135.5

(51) Int. Cl.
*B65D 85/10* (2006.01)
*B65D 43/16* (2006.01)

(52) U.S. Cl. ..... 206/268; 206/273; 229/160.1

(58) Field of Classification Search ..... 206/268, 206/259, 260, 261, 262, 263, 264, 265, 266, 206/267, 271, 273, 274, 276, 256, 258; 229/87.12, 229/87.13, 87.14, 160.1, 5.5, 5.8, 116.1
See application file for complete search history.

(56) References Cited

U.S. PATENT DOCUMENTS

| | | | | |
|---|---|---|---|---|
| 2,867,369 | A * | 1/1959 | Cernera | 206/268 |
| 5,651,454 | A * | 7/1997 | Trimani | 206/273 |
| 6,370,846 | B1 | 4/2002 | Schoch et al. | |
| 6,726,006 | B1 * | 4/2004 | Funderburk et al. | 206/268 |
| 2004/0055909 | A1 * | 3/2004 | Gamberi et al. | 206/271 |
| 2004/0074789 | A1 * | 4/2004 | Li Vigni et al. | 206/261 |
| 2005/0224375 | A1 * | 10/2005 | Focke et al. | 206/259 |

FOREIGN PATENT DOCUMENTS

EP 0 904 235 1/1998

OTHER PUBLICATIONS

International Search Report and Written Opinion corresponding to PCT/GB2007/000163 mailed on Apr. 25, 2007.
International Preliminary Report on Patentability corresponding to PCT/GB2007/000163 mailed on Aug. 19, 2008.

* cited by examiner

*Primary Examiner* — J. Gregory Pickett
*Assistant Examiner* — Ernesto A Grano
(74) *Attorney, Agent, or Firm* — Chadbourne & Parke LLP; Walter G. Hanchuk

(57) ABSTRACT

The curved pack end flap (20) of the present invention can generally be used in any pack that has a surface that is curved inwards. The curved pack end flap (20) incorporates multiple panels (27) interconnected at points (30) other than the folding edge (51) to provide for the deformation of the end flap when the surface, from which the curved pack end flap (20) is attached, is curved inwards during the formation of the pack. The folded curved pack end flap is subsequently affixed to a second surface in the formation of the pack. The curved pack end flap (20) with the interconnected panels (27) functions to maintain positional accuracy, decrease tearing of the end flap panels (27) during the folding process, and allow for glue application to be more precise during assembly as compared to the end flap of the prior art.

19 Claims, 6 Drawing Sheets

CURVED CIGARETTE PACK FLAP FORMATION ON CURVED SURFACES

CLAIM FOR PRIORITY

This application is a National Stage Entry entitled to and hereby claims priority under 35 U.S.C. §§365 and 371 corresponding to PCT Application No. PCT/GB2007/000163, titled, "CURVED CIGARETTE PACK FLAP FORMATION ON CURVED SURFACES," filed Jan. 19, 2007, which in turn claimed priority to British Application No. GB0603135.5, filed Feb. 16, 2006; all of which is hereby incorporated by reference.

The present invention is directed to a cigarette pack having a curved end flap. The curved pack end flap is formed of multiple interconnected panels which function to allow for deformation when the sidewall surface, to which the curved pack end flap is attached, is formed into a curved shape during assembly of the pack.

Various end flaps have been proposed in the art for curved surfaces of a pack. The end flap shown in FIGS. 1A and 1B is typical of the prior art. As shown in FIG. 1A, these end flaps 60 generally include panels 62 that are splayed along edges 66 from the connecting edge of the surface 64 continuing out through the outer substantially parallel edge 68 of the end flap. As shown in FIG. 1B, this splaying of the end flap 60 generally creates a three panel end flap that fans out when the surface 64 is curved and the end flap 60 is folded during assembly of the pack.

There are several disadvantages associated with the separated end flap 60 of FIGS. 1A and 1B. These existing end flaps 60 for curved surfaces do not maintain the interconnection, other than the folded edge, between the separate panels 62 that fan out. These separate splayed panels increase the total outer perimeter of the end flap, the total surface area coverage, and the number of separate panels of the end flap to be handled in the assembly of the pack which results in the increased likelihood that the separate panels will seize and tear on moving or stationary parts during assembly of the pack. Another disadvantage is that the end flap has three separate splayed panels that each must be folded and positioned, instead of a single end flap, which decreases the positional accuracy of each splayed panel. Still another disadvantage is that the glue application is less precise when positional accuracy of the splayed panels are less consistent, and wasteful since the three splayed panels have large gaps created when the panels separate from each other during deformation. The deformation results in an increased area for excess glue to pass beyond the targeted panels.

The present invention is directed to a curved pack end flap for curved cigarette packs. The curved pack end flap can be used on curved packs that are round, beveled, or generally any pack that has a surface that is curved. The curved pack end flap incorporates multiple panels interconnected at points other than the folded edge to provide for the deformation of the end flap when the surface, from which the curved pack end flap is attached, is curved during the formation of the pack. The folded curved pack end flap is subsequently affixed to a second surface in the formation of the curved pack, The edges of the curved pack end flap being adjacent to and parallel to the edge of the curved surface remain connected to said edge during the folding and deformation of the curved pack end flap during assembly of the pack.

Therefore, a general object of this invention is to provide a curved pack end flap to replace end flaps with multiple panels which are unconnected at points other than the folding edge and may tear in the folding process, making manufacture of the pack difficult.

Another object of this invention is to provide for a curved pack end flap, as aforesaid, which utilizes greater control of the end flap panels during assembly of the pack when the end flap is folded from flat, in the blank, through ninety degrees and when the side wall surface is curved.

Yet another object of this invention is to provide for a curved pack end flap, as aforesaid, which provides condensed surface area coverage and positional accuracy of the panels creating consistent and precise glue application during assembly.

Other objects and advantages of this invention will become apparent from the following description taken in connection with the accompanying drawings, wherein is set forth by way of illustration and examples, embodiments of this invention.

Figure 1A:
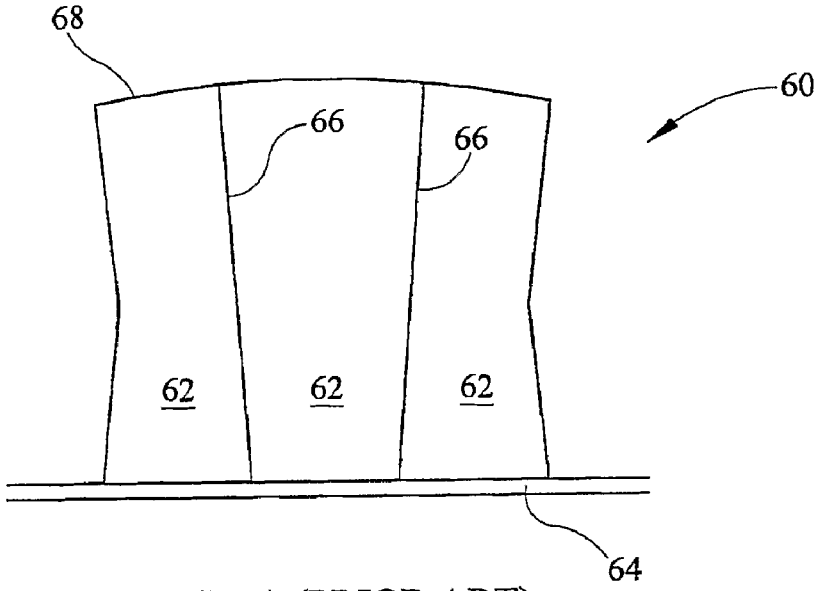
FIG. 1A (PRIOR ART)
FIG. 1A is a top view illustrating the pre-deformation configuration of an end flap of the prior art before the surface from which it extends, is folded and curved during assembly of the pack.

The curved pack end flap 20 of the present invention depicted in the drawings functions to maintain positional accuracy, decrease tearing of panels during machine handling during the assembly process, and allows for glue application to be more precise during assembly.

Figure 2:
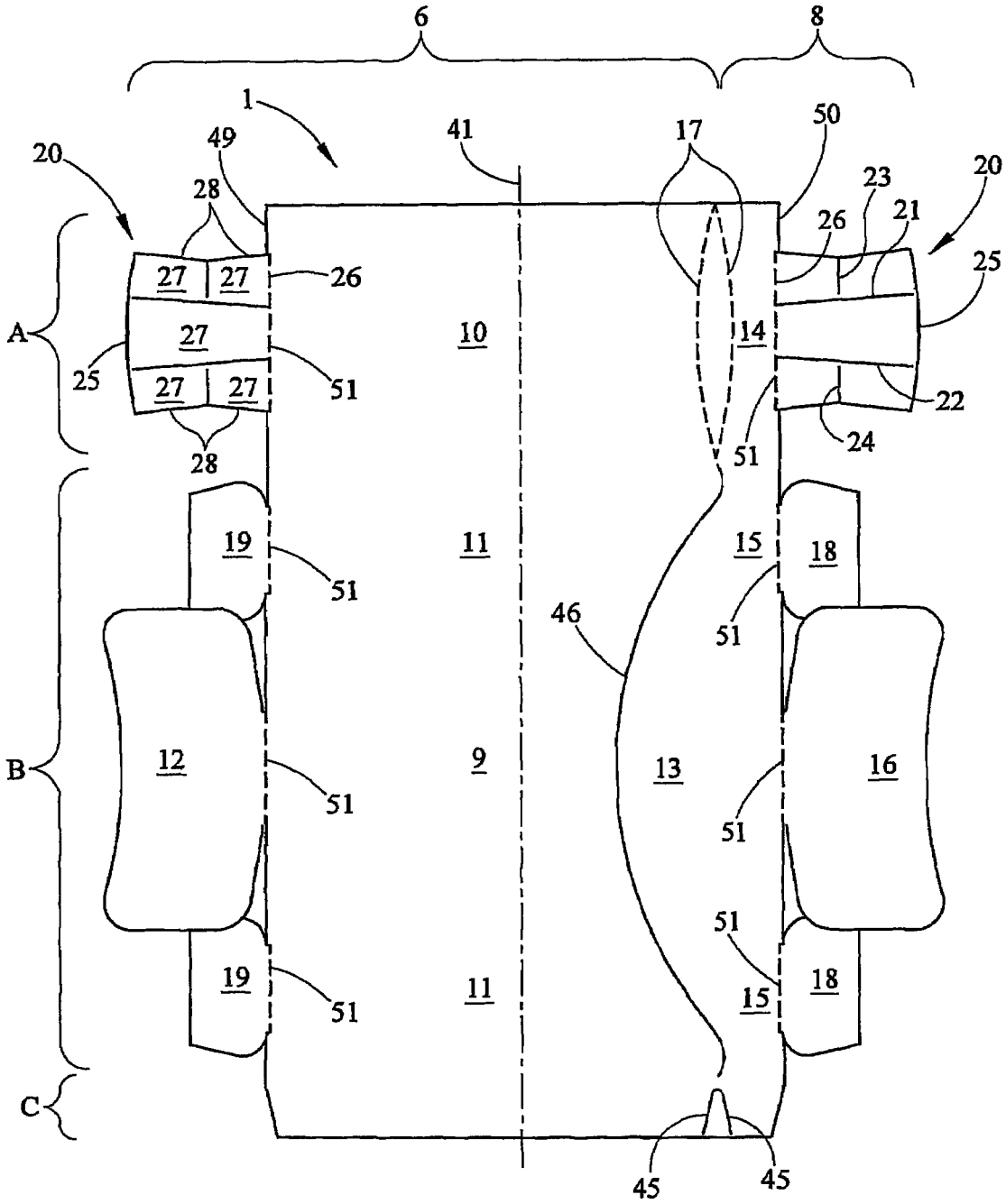
FIG. 2 is a plan view of a flat embodiment of the diecut blank with incorporated curved pack end flaps.

With reference to FIG. 2, a flat diecut blank 1 is obtained by shaping and punching a length (not illustrated) of a web of wrapping material such as cardboard or a similar material. The blank 1 is used to make a rigid curved pack 2, illustrated in FIGS. 3 and 4, designed to hold a bundle of product (not illustrated), such as cigarettes. The curved pack 2 is of the rigid hinged-lid type with a substantially parallelepiped shape comprising a cupped container body 6 having an open top end 7 (FIG. 4) and, surmounting the container, a similarly cupped lid 8 hingedly attached to the container 6 and rotatable between a position in which the lid 8 is open, as shown in FIG. 4, and a position in which the lid 8 is closed, as shown in FIG. 3.

Figure 3:
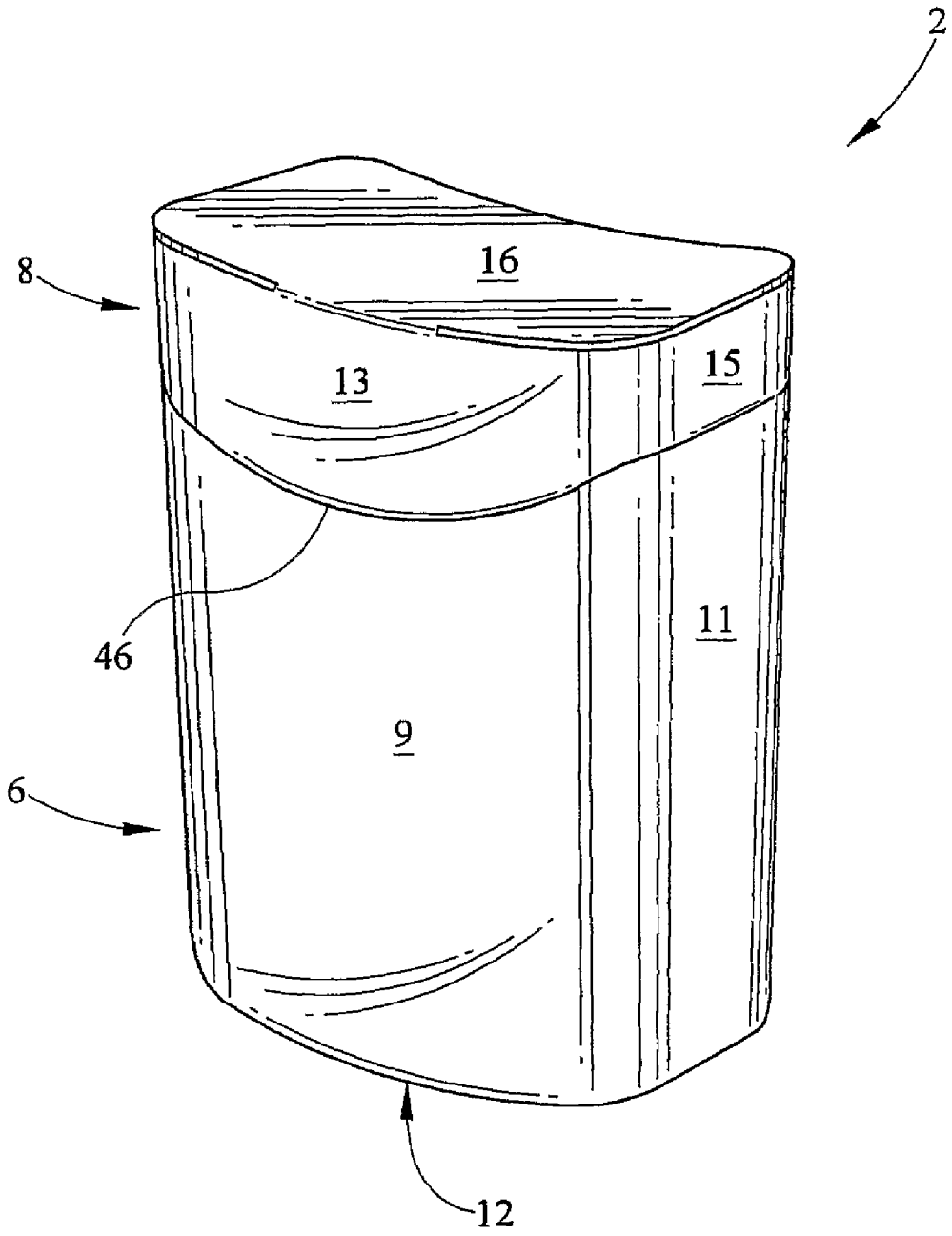
FIG. 3 is a top perspective view of a rigid curved pack with hinged lid made from the blank illustrated in FIG. 2.
Figure 4:
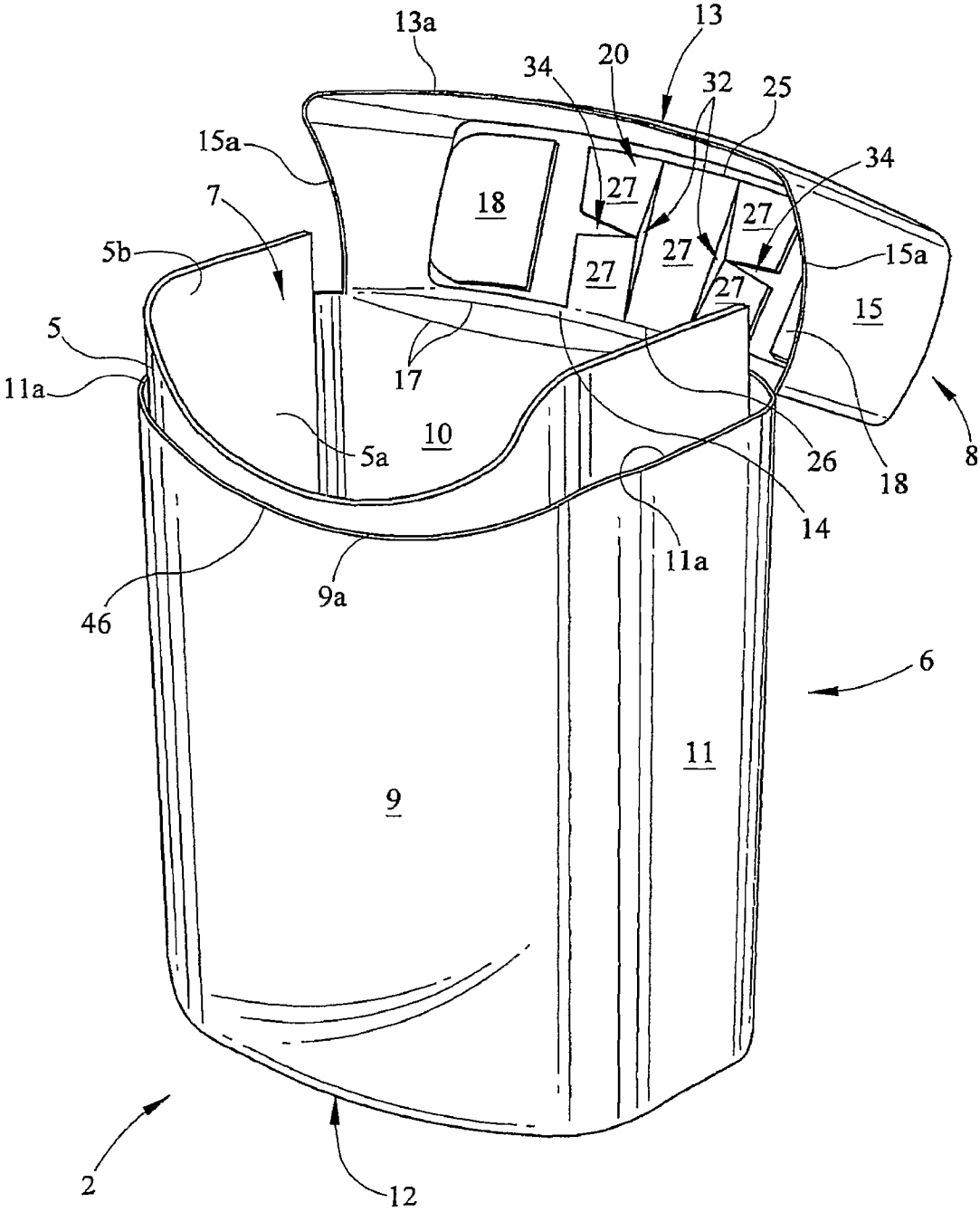
FIG. 4 is a top perspective view of a rigid curved pack illustrated in FIG. 3 with a hinged lid in an open position.

As shown in FIGS. 2, 3, and 4, the cupped container body 6 presents a convexly curved front surface 9 and a curved back surface 10 mutually opposed and substantially parallel, two mutually opposed and substantially parallel side surfaces 11 substantially perpendicular to the curved front surface 9 and the curved back surface 10, and a bottom panel 12 disposed orthogonally to the front, back and side surface consecutively 9, 10 and 11.

The lid 8 presents a curved front surface 13 and a curved back surface 14 mutually opposed and substantially parallel, two mutually opposed and parallel side surfaces 15 substantially perpendicular to the curved front surface 13 and the curved back surface 14, and a top panel 16 orthogonal to the front, back and side surfaces consecutively 13, 14 and 15.

The lid 8 is hingedly attached to the back surface 10 of the pack 2 along curved crease hinge line 17 (FIG. 4) about which the lid 8 is rotatable between the open position and the closed position mentioned above. The curved front surfaces 9 and 13 and the side surfaces 11 and 15 of the container body 6 and lid 8 present corresponding free edges 9*a*, 13*a*, 11*a* and 15*a* (FIG. 4) about which establish a line of demarcation 46 between the lid 8 and the container body 6 (FIG. 3).

As shown in FIG. 4, the rigid curved pack 2 incorporates a reinforcing inner frame 5, fixed to the inside of container body 6, which has a portion 5*a* disposed internally of the container body 6 and a remaining portion 5*b* that projects beyond the open top end 7 and functions as a supporting and restraining element for the lid 8 when in the closed position. Although the inner frame 5 is not shown in full detail, it should be understood that there are many variations of the inner frame that may be used with the present invention.

The curved pack 2 illustrated in FIGS. 3 and 4 is merely representative of curved packs in general, and it should be understood that there are many variations of curved packs that may be used with the end flaps of the invention.

As shown in FIG. 2, the diecut blank 1 is essentially rectangular in overall shape, relative to a longitudinal axis of symmetry 41, and is composed essentially of three portions arranged along the selfsame axis 41, namely a back section A, front and side sections B, and the overlap section C.

The blank 1, shown in FIG. 2, also comprises two parallel edges 49 and 50. The edges 49 and 50 establish preweakened fold lines 51 for various panels which panels form or reinforce various surfaces of the container 6 and the lid 8.

Figure 5:
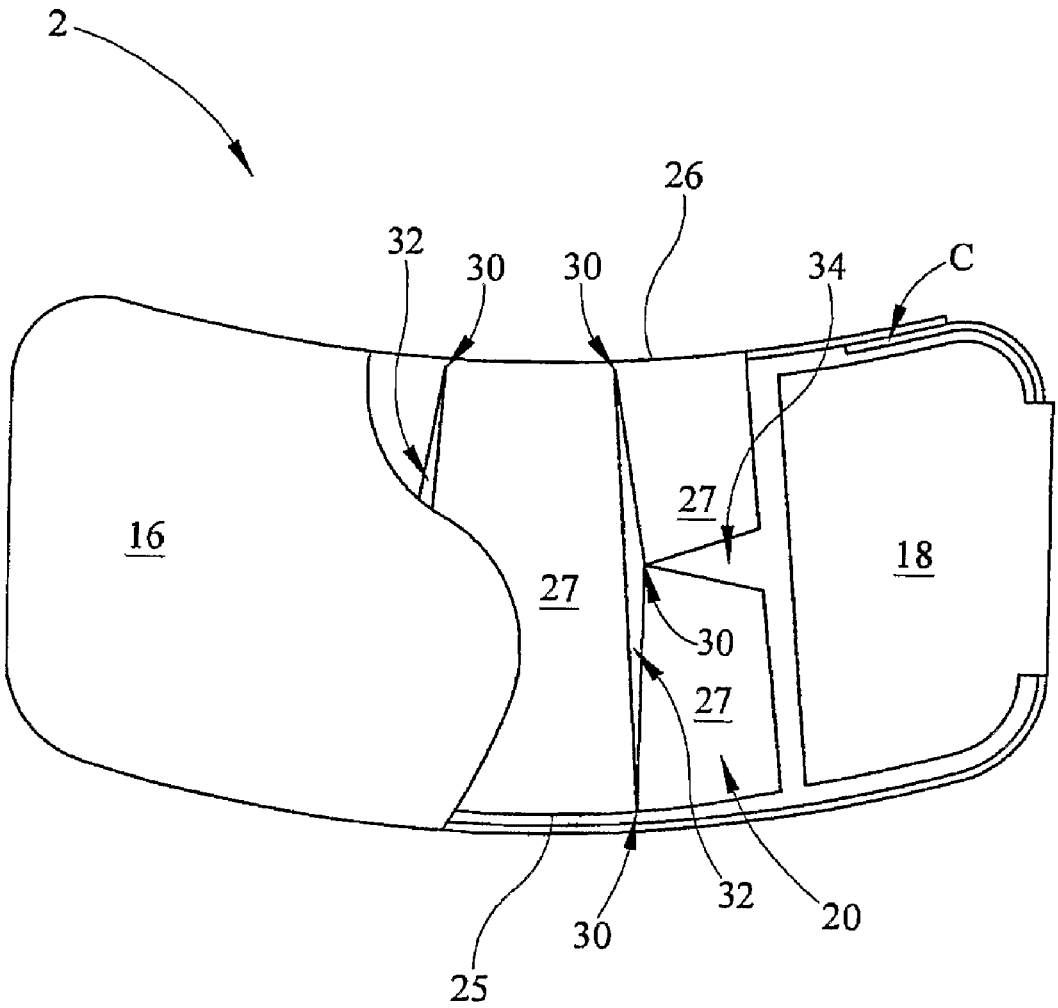
FIG. 5 is a top view of the rigid curved pack of FIG. 3 with the top panel partially broken away to illustrate the assembled position of a side flap and a curved pack end flap.

Shown in FIGS. 2, 3, 4, and 5, in regards to the back section A, the curved crease hinge lines 17 enable the rotation of the lid 8 from its open and closed positions, and divides the curved back surfaces into 10 and 14. Also, in regards to the front and side sections B, the pierced line of demarcation 46 divides and delineates the two portions of the curved front surfaces 9, 13 and the rounded side surfaces 11, 15 creating the demarcation between the lid 8 and the container body 6. The overlap section C, as shown in FIGS. 2 and 5, is the section for overlapping a portion of the back curved section A to create the curved substantially parallelepiped shaped pack as shown in FIGS. 3 and 4. The overlapping of the overlap section C and back section A align creased line 45 with curved creased hinge line 17 to allow the opening and closing of lid 8.

Although not shown in FIG. 2, panels 9, 10 and 11 may be separated by a precreased fold area number of parallel crease lines having a plurality of mutually parallel crease lines extending between longitudinal edges 49 and 50. When present the parallel crease lines assist in forming a container 6 and a lid 8 having rounded edges.

Further shown in FIGS. 2, 4, and 5, the two parallel edges 49 and 50 have preweakened fold lines 51 that are incorporated with various flaps and end panels which panels form or reinforce various surfaces. Incorporated in lid 8 are a top panel 16, two top side flaps 18, and a curved pack end flap 20. Incorporated in the container body 6 are a bottom panel 12, two bottom side flaps 19, and a curved pack end flap 20.

The side flaps 18 and 19 are positioned symmetrically on either side and centered on each top panel 16 or bottom panel 12 and extend from each longitudinal edge 49 and 50, respectively. The top panel 16 and bottom panel 12 are attached and centered approximately on the midpoint of the line of demarcation 46 and extend from each longitudinal edge 49 and 50, respectively. The curved pack end flap 20 are both centered on the back surfaces 10 and 14 and is positioned from the continuous inner edge 26 of each back surfaces 10, 14 and extend from each longitudinal edge 49, 50, respectively.

Figure 6A:
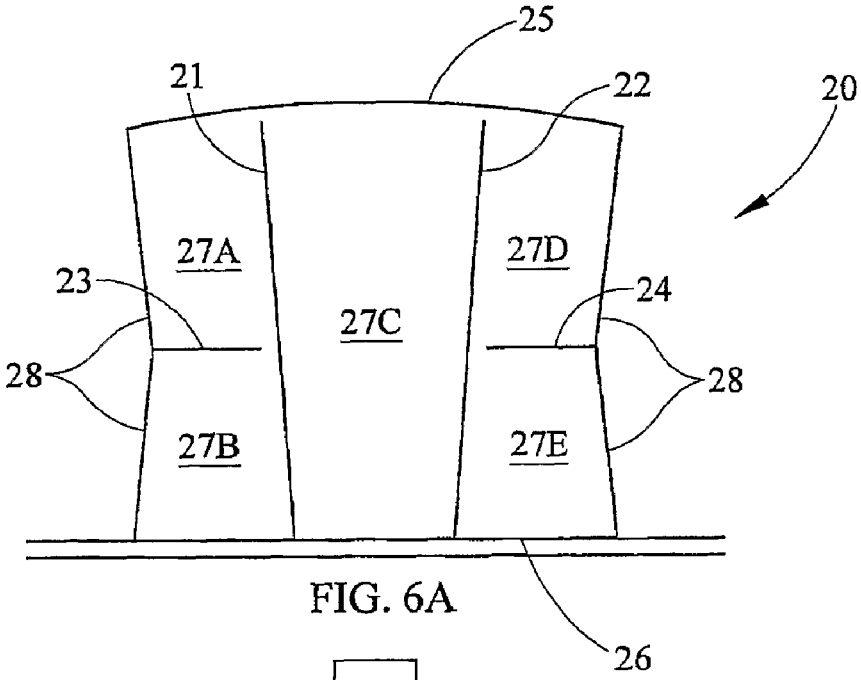
FIG. 6A is a top view illustrating the pre-deformation configuration of a curved pack end flap before the surface from which it extends, is folded and curved during assembly of the pack.
Figure 6B:
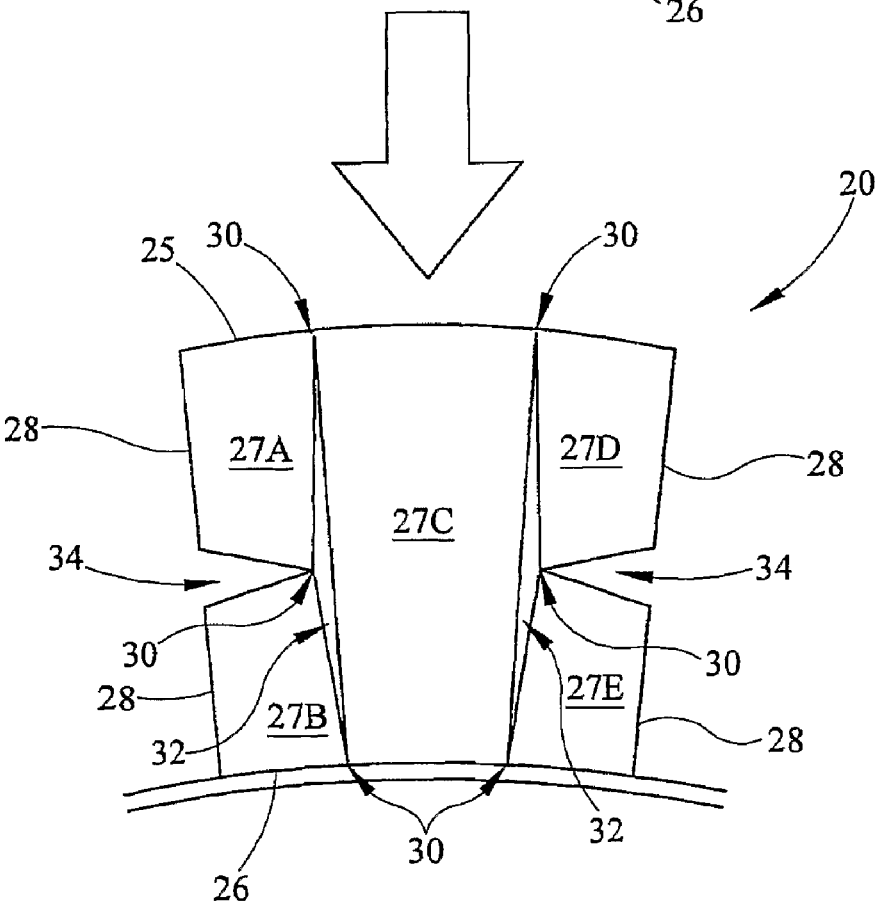
FIG. 6B is a top view illustrating the deformed configuration of a curved pack end flap after the surface from which it extends, is folded and curved during the assembly of the pack.

The curved pack end flap 20 is shown in FIGS. 2 and 6A in the pre-deformation configuration, as it appears in the diecut blank 1. During formation of the curved cigarette pack 2 (FIGS. 3, 4, and 5), a curved pack end flap 20 cohesively adhere both the top 16 and bottom 12 panels to each respective body 6 or lid 8 of the cigarette pack. Typical prior art end flaps extending from flat surfaces of the cigarette pack do not generate tension applied to the end flap during pack formation, however the curved pack end flap 20 of the present invention incorporates expansion areas 32, 34 able to relieve the tension created by curving the surface in a curved cigarette pack 2 from which it extends (FIGS. 5 and 6B). The curved pack end flap 20 as shown in FIGS. 2 and 6A incorporates, but is not limited to, five panels 27 interconnected and formed by cuts. Cuts 21 and 22 extend from the inner continuous edge 26, which coincides with each respective longitudinal edge 49, 50, of the back surfaces 10, 14 and extends to the opposing outer continuous edge 25 of the curved pack end flap, however without breaking the outer continuous edge 25. The fold line 51 of the back surfaces 10, 14 coincides with the inner continuous edge 26 of the curved pack end flap 20, Two cuts 23, 24 are substantially parallel to the fold line 51 and extend from each respective substantially perpendicular edge 28 of the curved pack end flap 20 to each respective cut 21 and 22, without breaking the boundary of the cuts 21, 22. Cuts 23 and 24, on the other hand, do break though each respective substantially perpendicular edge 28 of the curved pack end flap 20.

The curved pack end flap 20 is shown in FIGS. 4, 5, and 6B in the deformed configuration as a result of the back surface 10 of the main pack body and back surface 14 of the lid being curved and the curved pack end flap 20 folded about fold line 51 into position to be affixed to each respective top panel 16 and bottom panel 12. Shown in FIGS. 6A and 6B, an embodiment of the curved pack end flap 20 is shown with panels 27 further defined as 27A, 27B, 27C, 27D, and 27E. The panels 27 of curved pack end flap 20 are connected at multiple points 30 thereby interconnecting panels 27 of the curved pack end flap 20. The combination of cuts 21 and 23 create the upper left side panel 27A and the lower left side panel 27B. The combination of cuts 21 and 22 create the central panel 27C. The combination of cuts 22 and 24 create the upper right side panel 27D and the lower right side panel 27E. The outer continuous edge 25 is made up of the interconnectivity at multiple points 30 of panels 27A, 27C, and 27D. The inner continuous edge 26 is made up of the interconnectivity at multiple points 30 of panels 27B, 27C, and 27E.

As shown in FIGS. 4, 5, 6A, and 6B the combination of cuts 21, 22, 23, and 24 create closed ended triangular expansion areas 32 and open ended triangular expansion areas 34 allowing for tension relieving deformation of the curved pack end flap 20. The cut 23 allows for an open ended triangular expansion area 34 between upper left side panel 27A and lower left side panel 27B. The cut 24 also allows for an open ended triangular expansion area 34 between upper right side panel 27D and lower right side panel 27E. Each of the open ended triangular expansion areas 34 created by each respective cut 23, 24 do not have a continuous boundary edge. A closed ended triangular expansion area 32 is located on both sides of the central panel 27C. One closed ended triangular expansion area 32 resulting from cut 21 is located between panels 27A, 27B, and 27C. Another closed ended triangular expansion area 32 resulting from cut 22 is located between panels 27D, 27E, and 27C. Each of the closed ended triangular expansion areas 32 have a continuous boundary edge created by the combination of the central panel 27C and either the upper and lower left side panel 27A, 27B respectively or the upper and lower right side panel 27D, 27E respectively.

Figure 1B:
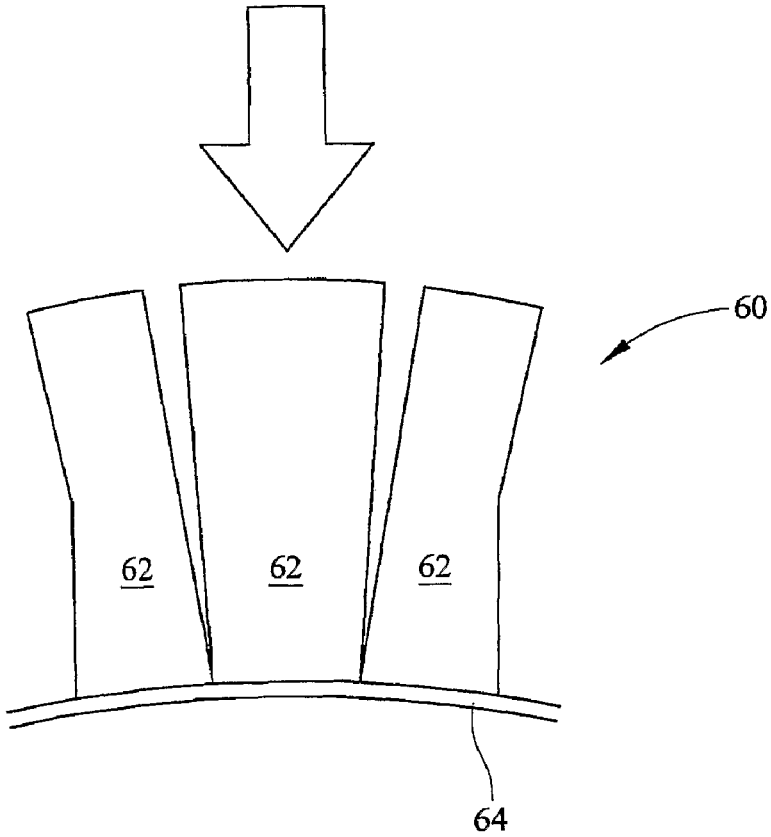
FIG. 1B (PRIOR ART)
FIG. 1B is a top view illustrating the deformed configuration of a end flap of the prior art after the surface from which it extends, is folded and curved during the assembly of the pack.

The curved pack end flap 20 incorporates the interconnected panels 27 that are interconnected at respective points 30 to maintain continuity among the panels 27 and create a more concise end flap, as compared to the separated end flap 60 of the prior art (FIGS. 1A and 1B). The interconnection of the panels 27 at multiple points 30 of the present invention minimizes the total outer perimeter of the curved pack end flap, decreases the total surface area coverage of the curved pack end flap, and allows the curved pack end flap to essentially remain integral. This decreases the likelihood that the curved pack end flap will seize and tear on moving or stationary parts when ploughed or folded during the assembly of the pack. Another advantage with maintaining the panels 27 interconnected once the curved pack end flap 20 is deformed is that the curved pack end flap continues to have an outer continuous edge 25 which minimizes the seizing and tearing of the curved pack end flap during machine handling. Also, the curved pack end flap 20 is essentially one interconnected flap instead of the three splayed panels 62 of the prior art (FIG. 1B) which allows in the placement and handling of the curved pack end flap to be kept substantially accurate during the assembly of the pack. Still another advantage is that the glue application is more precise and more efficient since the interconnected panels 27 of the curved pack end flap 20 present a smaller area to cover than the prior art splayed end flaps (FIGS. 1A and 1B) and maintains their positional accuracy during the glue application. This minimizes any gaps where excess glue can be lost or misapplied to the panels.

Although the curved pack end flap 20 is shown in detail in the drawings, it is merely representative of one embodiment of the present invention. There are many variations in the number and shapes of panels 27 and the number of interconnecting points 30 that may be used in the present invention to maintain panels 27 interconnected for use on curved surfaces of packs.

It is understood that while certain forms of the invention have been illustrated and described, it is not limited thereto except insofar as such limitations are included in the following claims and allowable functional equivalents thereof.

The invention claimed is:

1. A blank for forming a curved pack, comprising:

a main portion divided into a lid portion and a body portion;

the lid portion forming a curved front surface, a top surface, two side surfaces, two side flaps, and a curved back surface;

the body portion forming a curved front surface, a bottom surface, two side surfaces, two side flaps, and a curved back surface;

at least one end flap extending from an edge of at least one of the curved surfaces, the at least one end flap being formed of a plurality of separate panels interconnected at points other than at the edge of at least one of the curved surfaces, the at least one end flap including a continuous edge, formed by an upper left side panel, a central panel and an upper right side panel, opposite to the edge of at least one of the curved surfaces; and said end flap having a plurality of expansion areas staggered between said outer continuous edge and said curved back panel.

2. The blank as in claim 1, wherein said plurality of separate panels are formed by a first cut extending from said edge of at least one of the curved surfaces to a point adjacent to said continuous edge, and a second cut extending from a side edge of said at least one end flap to a point adjacent to said first cut.

3. The blank as in claim 1 wherein said plurality of separate panels is formed by a plurality of cuts in said at least one end flap.

4. The blank as in claim 1, wherein said at least one end flap comprises five separate panels.

5. The blank as in claim 4, wherein said at least one end flap extends from at least one of the curved back surfaces.

6. A curved pack with an end flap comprising:

a body having a curved front face mutually opposed and parallel to a curved back face, two parallel side faces transverse to said curved front and back faces and a bottom face transverse to said front, back and side faces, the body having a first end flap extending outward from an edge of the curved back face of the body and adhered to a bottom surface of the bottom face;

a lid hinged to said body, said lid having a curved front face mutually opposed and parallel to a curved back face, two parallel side faces transverse to said curved front and back faces and a top face transverse to said front, back and side faces, the lid having a second end flap extending outward from a second edge opposite to the edge of the curved back face of the body and adhered to a bottom surface of the top face;

wherein each end flap includes a plurality of separate panels each interconnected at points other than at the edge of the curved back face, wherein the plurality of separate panels are formed by a first cut extending from the edge of the curved back face to a point adjacent to a continuous edge opposite to the edge of the curved back face, and a second cut extending from a side edge of the flap to a point adjacent to said first cut.

7. The curved pack as in claim 6, wherein said end flap further comprises a plurality of cuts extending from at least one said point to section said plurality of separate panels.

8. The curved pack as in claim 6, wherein said end flap further comprises at least one triangular-shaped expansion area positioned between said plurality of separate panels.

9. The curved pack as in claim 6, wherein said end flap further comprises a first triangular-shaped expansion area located on two sides, parallel and opposed, of a central panel, and a second triangular-shaped expansion area located between upper and lower left side panels and upper and lower right side panels.

10. The curved pack as in claim 6, wherein said plurality of separate panels comprises a central panel with upper right and left side panels symmetrical and centered on said central panel, and lower right and left side panels symmetrical and centered on said central panel below said upper right and left side panels.

11. The curved pack as in claim 10 wherein said upper left side panel, central panel, and upper right side panel further comprise a continuous edge aligned with said interconnected points.

12. A flip-top cigarette pack comprising:

a body having a curved front panel, a bottom panel, and a curved back panel;

a lid hingedly connected to the body, the lid having a curved front panel, a top panel, and a curved back panel;

said curved back panel of said lid having an end flap extending outward and adhered to a bottom surface of said lid top panel; and said end flap having an outer continuous edge formed by an upper left side panel, a central panel and an upper right side panel, and at least one cut extending from said curved back panel of said lid to a point adjacent to said continuous edge.

13. The flip-top cigarette pack as in claim 12 wherein said end flap further comprises at least one side cut extending from a side edge of said end flap to a point adjacent to said at least one cut.

14. The flip-top cigarette pack as in claim 12 wherein said curved back panel of said body having a second end flap extending outward from said curved back panel of said body and adhered to a bottom surface of said bottom panel.

15. The flip-top cigarette pack as in claim 12 wherein said end flap further comprises a lower left side panel, and a lower right side panel, wherein each panel is interconnected at points other than at said outer continuous edge.

16. A flip-top cigarette pack comprising:

a body having a curved front panel, a bottom panel, and a curved back panel;

a lid hingedly connected to the body, the lid having a curved front panel, a top panel, and a curved back panel;

said curved back panel of said lid having an end flap extending outward and adhered to a bottom surface of said lid top panel, said end flap having a central panel, left upper and lower panels, and right upper and lower panels interconnected at points other than at an outer continuous edge; and said end flap having a plurality of expansion areas staggered between said outer continuous edge and said curved back panel.

17. The flip-top cigarette pack as in claim 16 wherein said plurality of expansion areas divide said end flap into a plurality of separate panels.

18. The flip-top cigarette pack as in claim 16 wherein said curved back panel of said body having a second end flap extending outward from said curved back panel of said body and adhered to a bottom surface of said bottom panel.

19. The curved pack as in claim 18 wherein said at least one end flap further comprises a first triangular-shaped expansion area located on two sides, parallel and opposed, of said central panel, and a second triangular-shaped expansion area located between said upper and lower left side panel and said upper and lower right side panel.

* * * * *